US008121534B2

(12) United States Patent
Mantel et al.

(10) Patent No.: US 8,121,534 B2
(45) Date of Patent: Feb. 21, 2012

(54) SYSTEM AND METHOD FOR SENDING AND RECEIVING IMAGES VIA WIRELESS AUDIO CHANNELS

(75) Inventors: George David Mantel, Boynton Beach, FL (US); Paul David Marko, Pembroke Pines, FL (US); Mark Rindsberg, Boca Raton, FL (US); Michael A. Barton, Coral Springs, FL (US)

(73) Assignee: Sirius XM Radio Inc., New York, NY (US)

( * ) Notice: Subject to any disclaimer, the term of this patent is extended or adjusted under 35 U.S.C. 154(b) by 1162 days.

(21) Appl. No.: 11/528,971

(22) Filed: Sep. 27, 2006

(65) Prior Publication Data

US 2008/0125030 A1 May 29, 2008

(51) Int. Cl.
*H04H 20/74* (2008.01)

(52) U.S. Cl. ..... 455/3.02; 455/3.06

(58) Field of Classification Search ..... 455/3.02, 455/3.06, 414.1, 461, 3.01; 370/338, 401, 370/235, 395.5, 404, 265.09, 310; 379/218, 379/219; 725/62–70

See application file for complete search history.

(56) References Cited

U.S. PATENT DOCUMENTS 4,633,329 A * 12/1986 Sugiyama et al. ..... 386/308
6,510,317 B1 1/2003 Marko et al.
6,725,022 B1 * 4/2004 Clayton et al. ..... 455/154.1
6,823,169 B2 11/2004 Marko et al.
6,900,777 B1 * 5/2005 Hebert et al. ..... 345/7
7,334,249 B1 * 2/2008 Byers ..... 725/35
7,380,708 B1 * 6/2008 Kiliccote ..... 235/380
7,454,166 B2 * 11/2008 Patsiokas et al. ..... 455/3.06
2003/0210337 A1 * 11/2003 Hall ..... 348/231.99
2003/0231806 A1 * 12/2003 Troyanker ..... 382/305
2004/0150723 A1 * 8/2004 Seo et al. ..... 348/207.1
(Continued)

OTHER PUBLICATIONS

European Broadcasting Union, Digital Audio Broadcasting (DAB) ETSI TS 101 499, V2.1.1 (Jan. 2006).

(Continued)

*Primary Examiner* — Dominic E Rego
(74) *Attorney, Agent, or Firm* — Roylance, Abrams, Berdo & Goodman, LLP

(57) ABSTRACT

A system and method for adding images to a wireless audio service. The invention is adapted for use in a system for wirelessly transmitting and receiving an audio data stream and includes an arrangement for providing an image and a mechanism for inserting the image into the data stream prior to transmission thereof. In the illustrative embodiment, a third arrangement is provided for receiving and decoding the data stream to extract and a fourth arrangement is included for displaying the image while the audio signal is output. The fourth arrangement may be a digital radio, i.e., a radio adapted to process digital signals, such as a satellite radio, high definition radio, digital AM or other suitable primarily audio wireless communication system. In a specific embodiment, the invention includes an arrangement for automatically inserting a selected image in the stream. In the illustrative embodiment, this arrangement includes a source selector, an image editor coupled to the source selector, an image resizer, an image compressor, and an arrangement for allowing a user to add text, color, style and/or other information to an image output by the compressor. The invention further includes an arrangement for adding images from an archive to the stream and a graphical picture show composer for providing an image queue. An image server is included for feeding the image queue to the output data stream provided by a system server such as an XM or Sirius satellite radio server.

18 Claims, 12 Drawing Sheets

U.S. PATENT DOCUMENTS

2005/0013585 A1* 1/2005 Ono ..... 386/46
2005/0128286 A1* 6/2005 Richards ..... 348/36
2005/0216346 A1* 9/2005 Kusumoto et al. ..... 705/14
2005/0219366 A1* 10/2005 Hollowbush et al. ..... 348/193
2006/0044582 A1* 3/2006 Seaman et al. ..... 358/1.13
2006/0133770 A1* 6/2006 Shibata et al. ..... 386/68
2006/0171474 A1* 8/2006 Ramaswamy et al. ... 375/240.27
2006/0187339 A1* 8/2006 Kong ..... 348/423.1
2006/0206582 A1* 9/2006 Finn ..... 709/217
2006/0271991 A1* 11/2006 Bae et al. ..... 725/118
2007/0033609 A1* 2/2007 Dei ..... 725/25
2007/0130292 A1* 6/2007 Tzruya et al. ..... 709/219
2007/0150375 A1* 6/2007 Yang ..... 705/26
2007/0162571 A1* 7/2007 Gupta et al. ..... 709/219
2007/0222734 A1* 9/2007 Tran ..... 345/98
2007/0242066 A1* 10/2007 Levy Rosenthal ..... 345/419
2007/0254716 A1* 11/2007 Matsuoka et al. ..... 455/561
2008/0117471 A1* 5/2008 Tsubaki et al. ..... 358/302
2008/0131071 A1* 6/2008 Ogikubo ..... 386/46
2008/0253565 A1* 10/2008 Fontijn ..... 380/255
2008/0318518 A1* 12/2008 Coutinho et al. ..... 455/3.06
2009/0216623 A1* 8/2009 Hendricks et al. ..... 705/10

OTHER PUBLICATIONS iBiquity Digital, HD Radio, HD Broadcast Multimedia Language Specification, Rev. A, Sep. 30, 2003.

iBiquity Digital, HD Radio, Thom Linden, An Advanced Application Services Framework for Application and Service Developers using HD Radio Technology, Feb. 1, 2003.

* cited by examiner

100
Image Data Service Component Packets
Packet Header
Application Data
CRC
Packet Header
Application Data
CRC
Packet Header
Application Data
CRC Message Sync Packet
85
Msg Sync Header
86
Message
Msg CRC
88

Message Packet
Msg Type ID
82
Message Type Specific Data
84
80

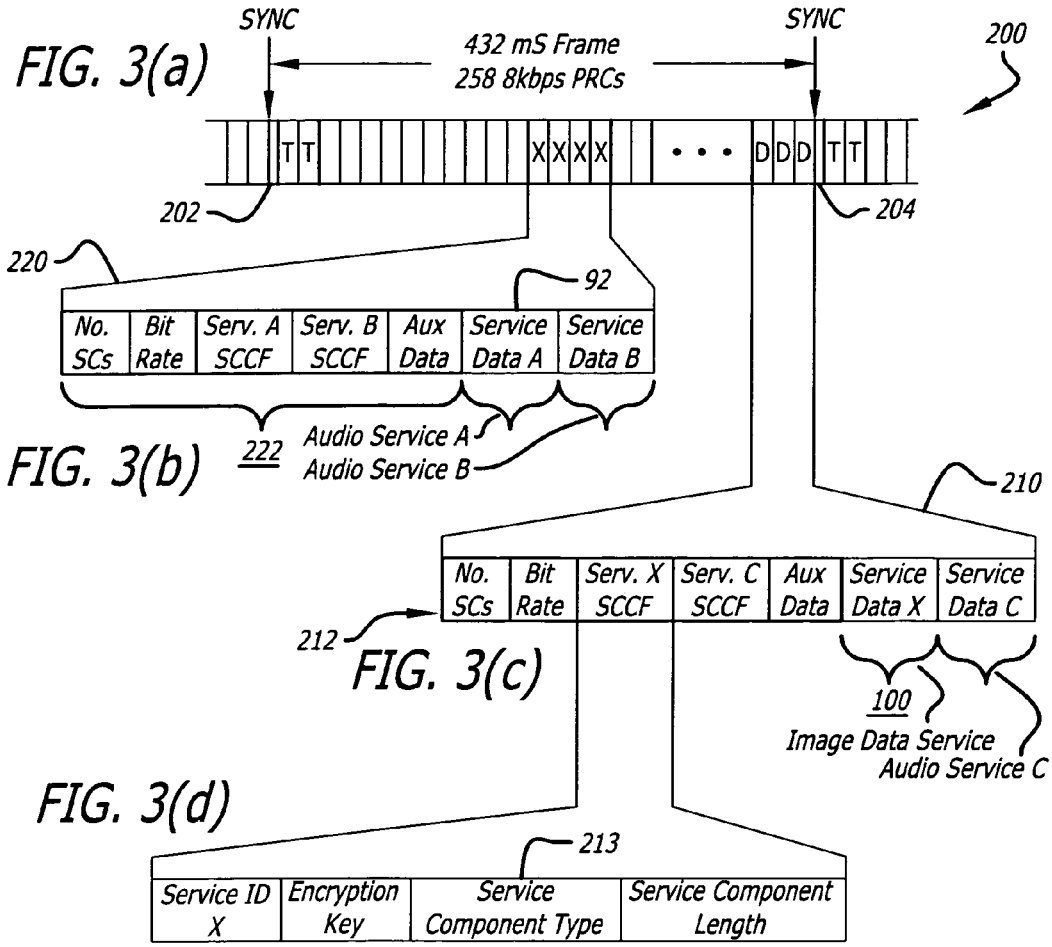
FIG. 3(a)
SYNC
432 mS Frame
258 8kbps PRCs
SYNC
200
T T
X X X X
• • •
D D D
T T
202
204
220
92
No. SCs
Bit Rate
Serv. A SCCF
Serv. B SCCF
Aux Data
Service Data A
Service Data B
222
Audio Service A
Audio Service B
FIG. 3(b)
210
No. SCs
Bit Rate
Serv. X SCCF
Serv. C SCCF
Aux Data
Service Data X
Service Data C
212
FIG. 3(c)
100
Image Data Service
Audio Service C
FIG. 3(d)
213
Service ID X
Encryption Key
Service Component Type
Service Component Length

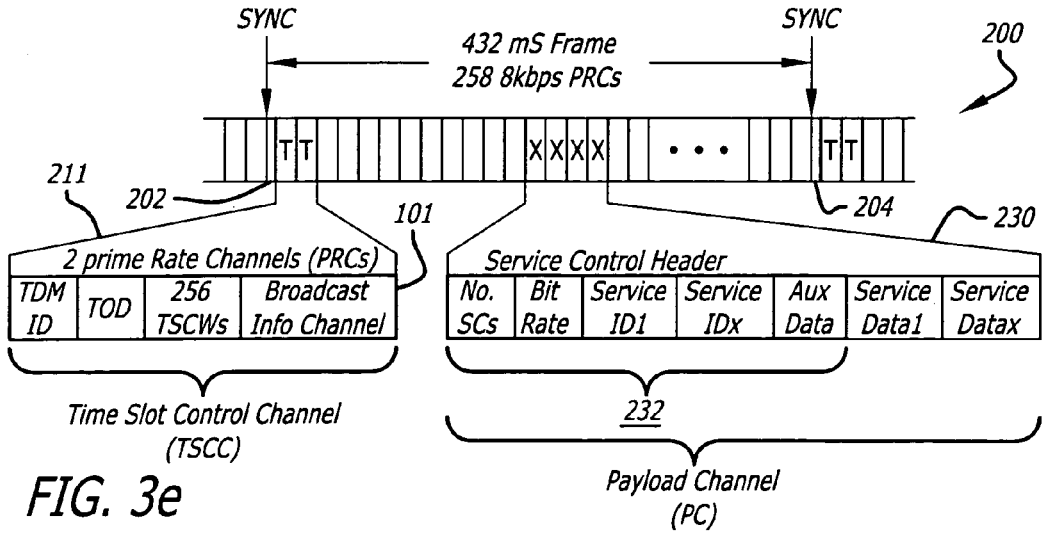
SYNC
432 mS Frame
258 8kbps PRCs
SYNC
200
T T
X X X X
• • •
T T
211
202
204
101
230
2 prime Rate Channels (PRCs)
TDM ID
TOD
256 TSCWs
Broadcast Info Channel
Service Control Header
No. SCs
Bit Rate
Service ID1
Service IDx
Aux Data
Service Data1
Service Datax
Time Slot Control Channel
(TSCC)
232
Payload Channel
(PC)
FIG. 3e

SYSTEM AND METHOD FOR SENDING AND RECEIVING IMAGES VIA WIRELESS AUDIO CHANNELS

BACKGROUND OF THE INVENTION

1. Field of Invention

This invention relates to communications systems and methods. Specifically, the present invention relates to systems and methods for broadcasting content via wireless networks.

2. Description of the Related Art

Numerous over-the-air (wireless) audio broadcast services are available for the consumer including conventional AM and FM radio and, more recently, satellite (e.g. XM) radio. Additional service offerings are in development including High Definition Radio and Digital AM radio.

Currently, these offerings are audio only. That is, conventional wireless broadcast technologies provide only an audio signal for the consumer.

However, these audio only services would be enhanced by the transmission and display of visual information, including images, that are synchronized and relevant to associated audio services.

Unfortunately, current and planned audio only wireless broadcast systems have no means for providing such visual imagery. Accordingly, a need exists in the art for a system or method for providing images synchronized and relevant to associated audio program content in a wireless audio broadcast network.

SUMMARY OF THE INVENTION

The need in the art is addressed by the system and method of the present invention. The invention is adapted for use in a system for wirelessly transmitting and receiving an audio data stream and includes an arrangement for providing an image and a mechanism for inserting the image into the data stream prior to transmission thereof.

In the illustrative embodiment, a third arrangement is provided for receiving and decoding the data stream to extract and a fourth arrangement is included for displaying the image while the audio signal is output. The fourth arrangement may be a digital radio, i.e., a radio adapted to process digital signals, such as a satellite radio, high definition radio, digital AM or other suitable primarily audio wireless communication system.

In a specific embodiment, the invention includes an arrangement for automatically inserting a selected image in the stream. In the illustrative embodiment, this arrangement includes a source selector, an image editor coupled to the source selector, an image resizer, an image compressor, and an arrangement for allowing a user to add text, color, style and/or other information to an image output by the compressor. The invention further includes an arrangement for adding images from an archive to the stream and a graphical picture show composer for providing an image queue.

An image server is included for feeding the image queue to the output data stream provided by a system server such as an XM or Sirius satellite radio server.

BRIEF DESCRIPTION OF THE DRAWINGS

FIG. 3(*a*) is a diagram showing an over the air payload channel adapted for in use in connection with satellite digital audio radio service transmission of Rolling Images in accordance with the present teachings.

FIG. 3(*b*) is a diagram showing typical audio payload channel as conventionally disposed within an over the air payload channel adapted for the transmission of audio data in accordance with conventional teachings.

FIG. 3(*c*) is a diagram showing an expansion of the Payload Channel that contains a Service Component adapted for the transmission of image data in accordance with an illustrative embodiment of the present teachings.

FIG. 3(*d*) is a diagram showing an expansion of the Service Component Control Field (SCCF) of the Payload Channel depicted in FIGS. 3(*a-c*).

FIG. 3*e* is a diagram showing the TSCC (Time Slot Control Channel) in accordance with an illustrative embodiment of the present teachings.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figures 1, 1A:
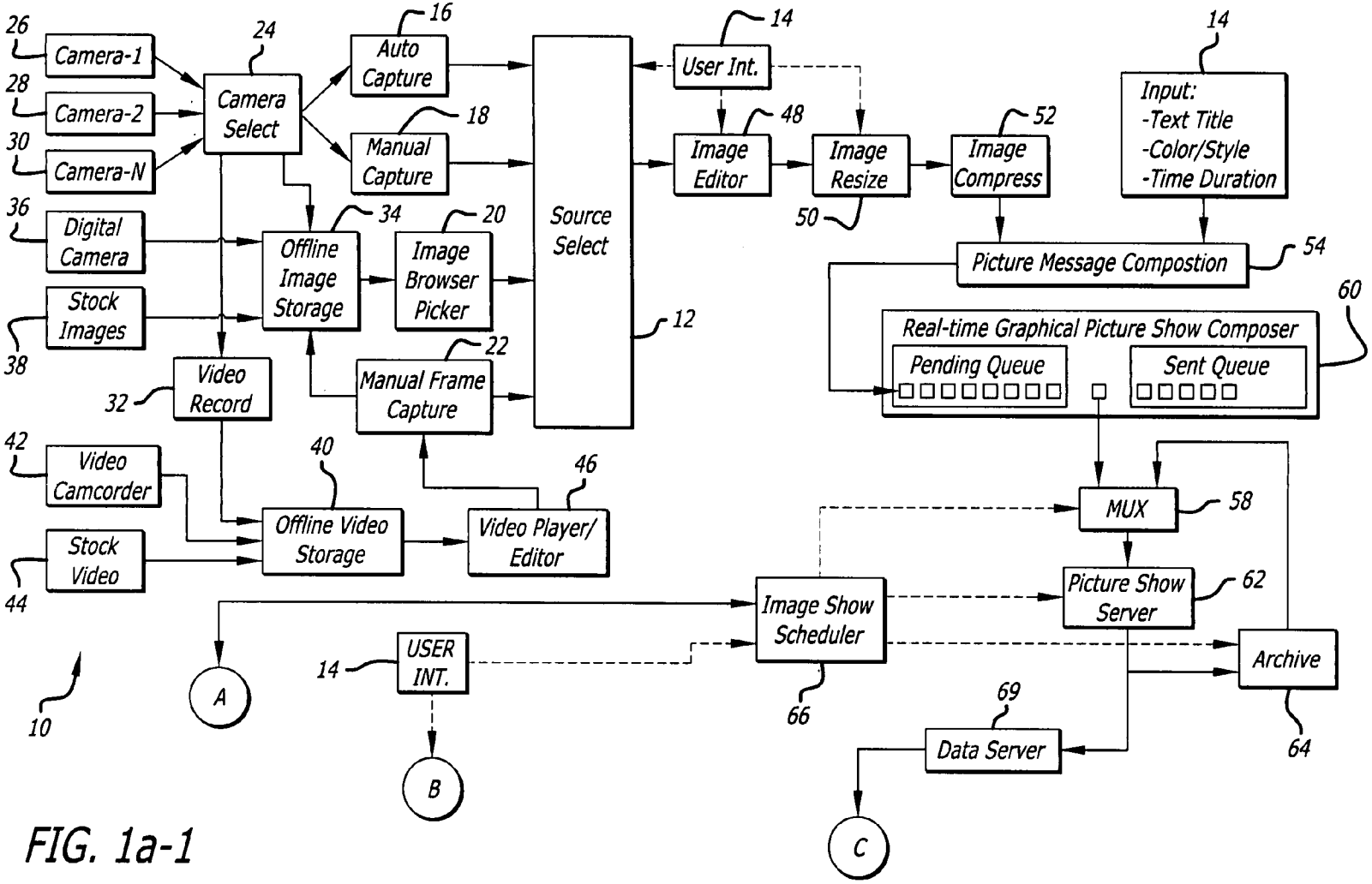
FIG. 1*a* is a block diagram of an illustrative embodiment of the system for sending images via wireless audio channels in accordance with the present teachings.

FIG. 1*a* is a block diagram of an illustrative embodiment of the system for sending images via wireless audio channels in accordance with the present teachings. As shown in FIG. 1*a*, the system 10 includes a source selector 12. The source selector 12 may be implemented with a software-controlled switch. In response to a control signal from a user interface 14, the source selector 12 selects images from an auto-capture system 16, a manual capture system 18, an image browser 20, and a manual frame capture system 22. These units enable a user to select between auto and manual capture of images from one of a number of cameras 26, 28 and 30 via a camera select circuit 24.

Selected images from the cameras may also be sent to a video recorder for storage. Images from a digital camera 36 and stock images may be stored offline (via storage elements 34 and 40. The browser 20 allows a user to select individual images to be streamed in accordance with the present teachings. The storage elements may also supply video from a camcorder 42 or a source of stock video 44. The stored video may be edited via a player/editor 46 and individual frames therefrom may be captured manually via manual frame capture system 22.

Images from the selected source are output by the source selector 12 to an image editor 48. The image is then sized for a desired format by an image resizer 50. Current typical image sizes are 130 by 130 pixels to 176 by 220 pixels. In the illustrative embodiment, the images are formatted in accordance with a compressed JPEG format at 176 by 220 pixels.

In practice the editor 48 and resizer 50 are implemented in software running on a microprocessor in response to inputs from a user via the interface 14. The image is then compressed by a conventional image compressor 52. As is known in the art, the image compressor 52 may be implemented in software or in hardware. The output of the compressor is input to routine or element 54 adapted to effect picture message composition with additional input from a user with respect to text, color, time duration etc. The composite image is fed to a real-time graphical picture show composer 60. The picture show composer allows a user to arrange the output order of the images in the queue. The images are output via a picture show server 62. These images may be stored in an archive 64 and selected for output via a scheduler 66 and the multiplexer 58. The multiplexer 58 allows a user to select between a currently composed show via the output of the Real-time Graphical Picture Show Composer 60 and a program stored in the archive 64 via the user interface 14.

The system 10 is adapted for use with a baseline wireless audio system 70. In the illustrative embodiment, the baseline audio system 70 is a satellite digital audio radio service (SDARS) system without imaging support. However, those of ordinary skill in the art will appreciate that the present teachings are not limited thereto. The present invention is not limited to the baseline system shown. The invention may be used with other baseline systems without departing from the scope of the present teachings.

In the illustrative embodiment, the baseline system 70 includes numerous audio only channels 72 and a first audio channel 71 to which transmitted image (visual) data (from 69) is synchronized and associated.

Each audio channel includes a Source 73, a Song/Program Scheduler 79, and an Audio Encoder 85. The Source 73 can be a stored database of audio songs/programs or can be an audio stream provided by some external audio source. Along with each song/program in the source is PAD data (Program Associated Data). The common PAD info provided by the Baseline (Audio Only) system is Artist Text Labels and Song Text Labels (low bandwidth data). Specific Songs/Programs from the Source are scheduled and requested for transmission by the Song/Program Scheduler 79. Upon a specific Song/Program being requested by the Song/Program Scheduler for transmission, the Source 73 begins output of the audio data along with the PAD data for this Song/Program. The audio data is sent to the Audio Encoder 85 which compresses the audio data to minimize over-the-air bandwidth usage.

The Service Layer 91 receives the output of each Audio Encoder (along with PAD data) and also receives the output of other non-audio Service Types, as in the Image Data from the Data Server 69. These inputs are the Service Components. The Service Layer generates the Payload Channels that carry the Service Components. The Payload Channel is shown in FIGS. 3*b*, 3*c* and 3*e*.

The Transport Layer 93 receives the Payload Channels from the Service Layer 91. The Transport Layer applies forward error correction, data interleaving and multiplexing of the Payload Channels into the 432 msec Frame shown in FIG. 3*a*.

Figure 3F:
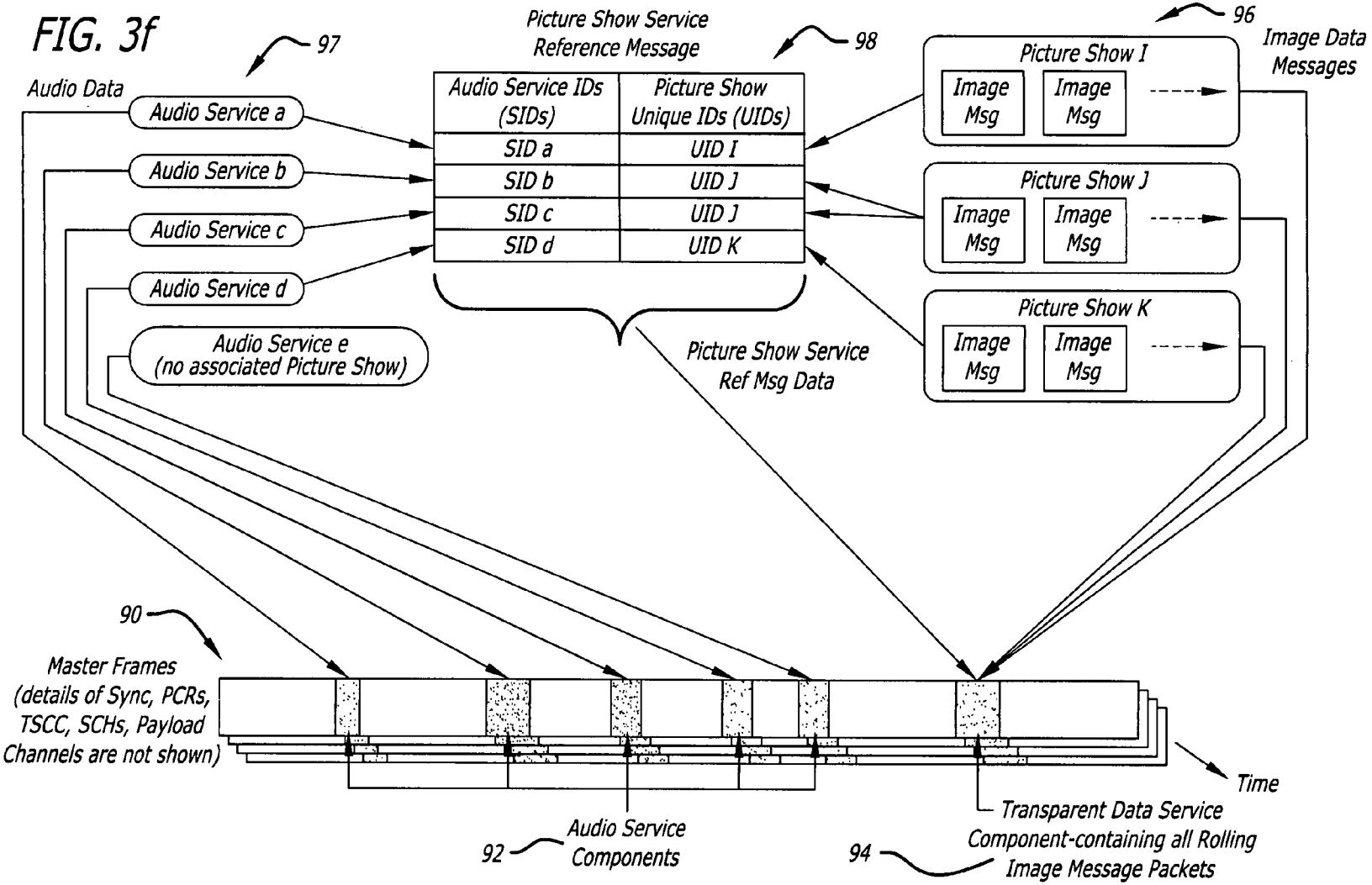
FIG. 3*f* is a diagram showing an association of picture shows to audio services and insertion into a transport layer in accordance with an illustrative embodiment of the present teachings.

The Physical Layer 95 receives input from the Transport Layer 93. The Physical Layer 95 defines the physical transport signal including modulation. The User Interface 14 programs the Song/Program Scheduler 79 (for each Audio Channel) so that the desired sequence of Songs/Programs are played at the desired times. The same User Interface 14 also programs the Image Show Scheduler 66 so that desired Picture/Image Shows are scheduled to begin at the desired times, and thus synchronized with the associated audio channel Song/Program. This method of audio-to-image synchronization is depicted in FIG. 3*f* and is described in more detail further below.

Figure 3G:
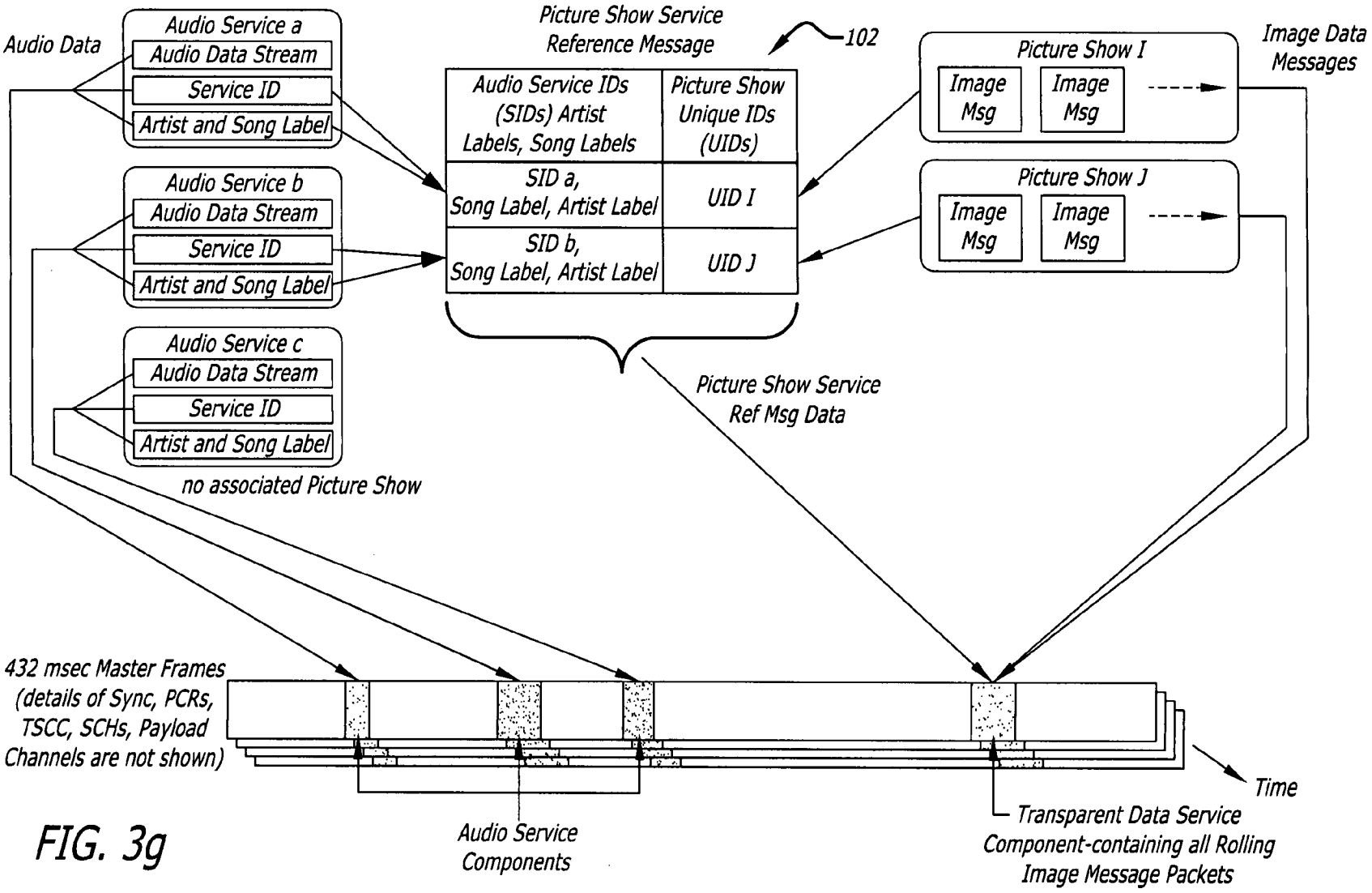
FIG. 3*g* is a diagram showing an association of picture shows to audio services by labels and insertion into a transport layer in accordance with an alternative embodiment of the present teachings.

Another method of audio-to-image synchronization is as follows: The User Interface 14 programs the Image Show Scheduler 66 to start playing specific Picture/Image Shows whenever the audio source outputs a specific PAD data pattern i.e. specific Artist and/or Song Text Labels. The Image Show Scheduler 66 monitors the PAD output of the specified audio source for the specified Artist and/or Song Labels. When a matching Labels are detected, the Image Show Scheduler 66 starts the playing of the specified Picture/Image Show. This method of audio-to-image synchronization is depicted in FIG. 3*g* and is described in more detail further below.

Figures 1, 1A, 2:
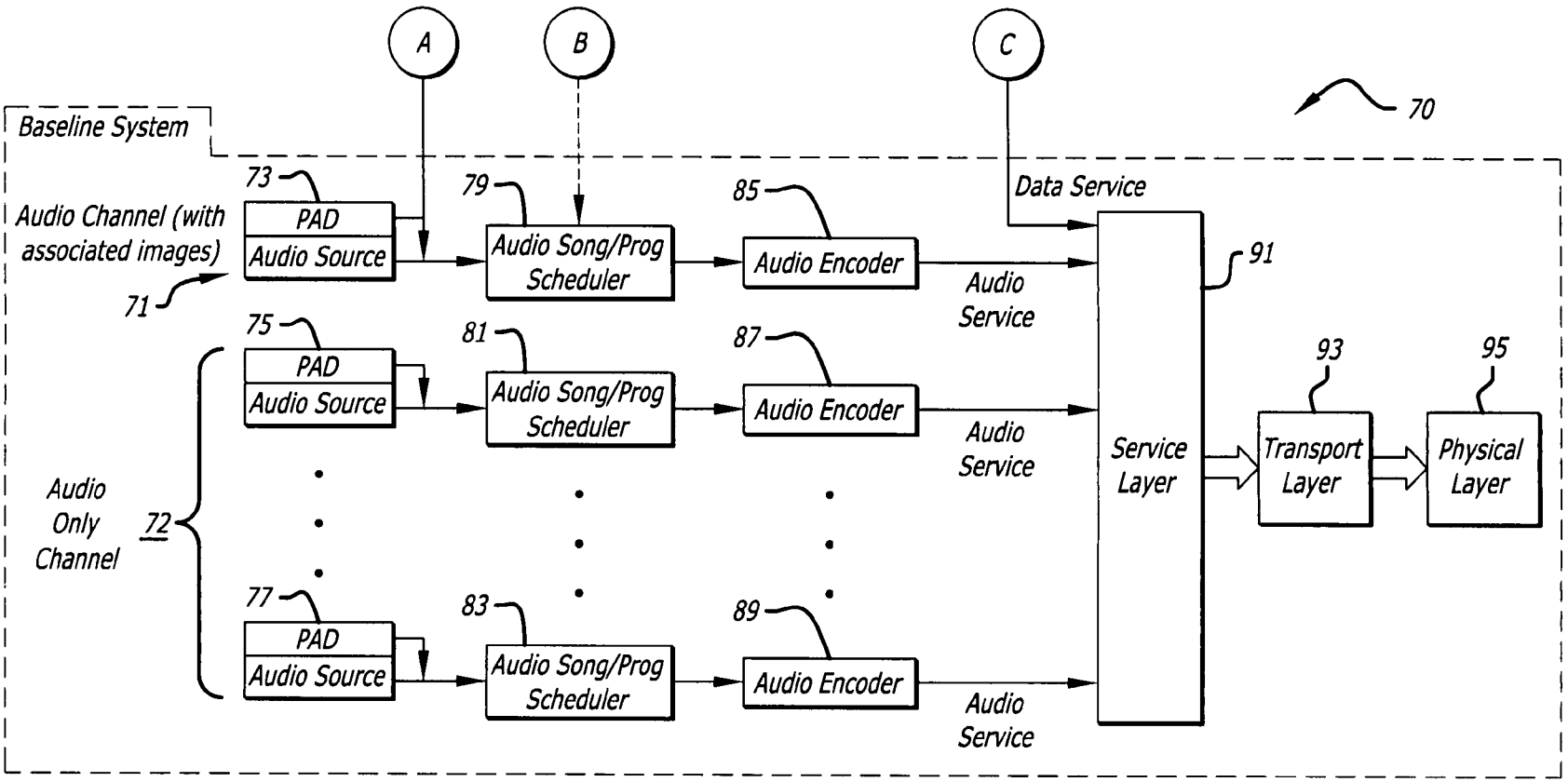
Figure 1B:
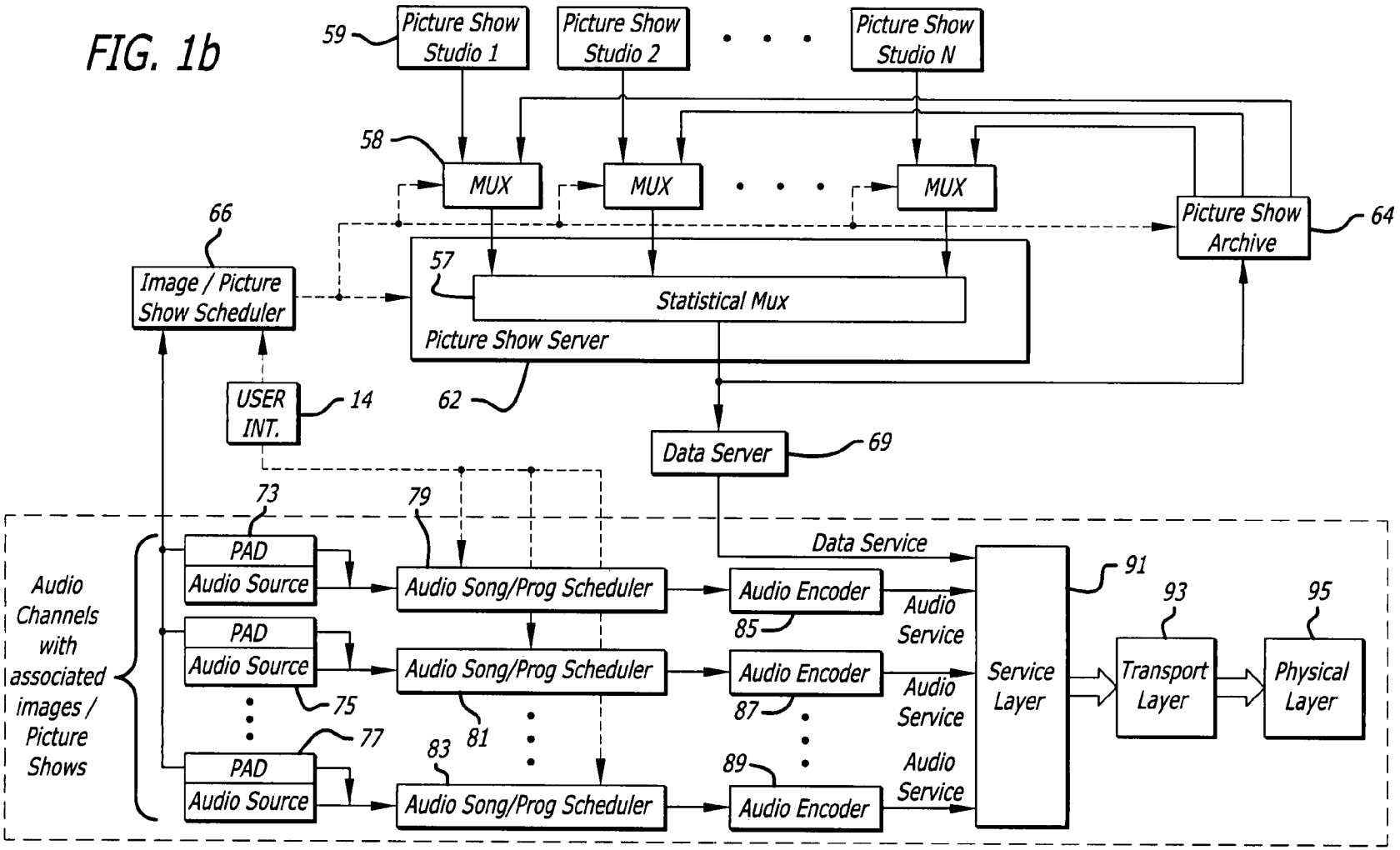
FIG. 1*b* is a block diagram which shows an arrangement for multiplexing the outputs of several Picture Show Studios in accordance with an illustrative embodiment of the present teachings.

In FIG. 1*a*, the sub-system consisting of all components in the chain leading up to and including the Real-time Graphical Picture Show Composer 60 is referred to herein as a "Picture Show Studio". An overall system that contains multiple Picture Shows linked to multiple Audio Channels is shown in FIG. 1*b*. In this figure, the Picture Show Server 62 is extended to receive image data input from multiple Picture Show Studios 59 or multiple archived Picture Shows as selected by the source multiplexers 58. The Picture Show Server 62 combines the image data from the multiple input sources via a Statistical Multiplexer (Mux) 57, and outputs the image data onto a single output stream to the Data Server 69. This output stream to the Data Server, and into the system 70 as a Data Service, is a fixed bit rate data stream. The bit rate for this Data Service is configured to a value suitable to handle the average bit rate requirements of all Picture Shows currently playing. Each Picture Show image data stream can be configured to maintain a different average bit rate. In the illustrative embodiment, the Picture Show Server enforces a rule that the combined average bit rates of all the currently playing Picture Shows do not exceed the fixed bit rate available for the Data Service. The Statistical Mux 57 handles the cases where the instantaneous combined bit rate of all the currently playing Picture Shows exceeds the available fixed Data Service bit rate. Currently available statistical multiplexing methods are used to accomplish this, including longer term buffering of input image data, and short-term reduction of bit rate by the dropping of image frames or increasing image data compression at the expense of image quality.

FIG. 1*b* is a block diagram that shows an arrangement for multiplexing the outputs of several Picture Show Studios in accordance with an illustrative embodiment of the present teachings. In FIG. 1*b*, the Image/Picture Show Scheduler 66 also specifies (via User Interface 14) which Picture Show Images are associated with which Audio Channels. A single Picture Show can be associated with a single Audio Channel or with multiple Audio Channels. In the latter case, the association can also be accomplished by specifying an entire audio category e.g. Rock, News or Sports. In this case, all Audio Channels that belong to that Category will have the same associated Picture Show. Note that a single stream of the Picture Show image data is transmitted and shared for each of the multiple associated Audio Channels i.e. the Picture Show image data is not replicated and transmitted for each of the multiple associated Audio Channels. The Image/Picture Show Scheduler 66 communicates the Audio Channel Association information to the Picture Show Server 62. The Picture Show Server 62 produces the Picture Show Reference Messages 98 (FIG. 3*f*) and 102 (FIG. 3*g*) that contain the Audio Channel association information. The Picture Show Reference Messages are transmitted along with the other image data messages to the Data Server 69.

Figures 2A, 2B, 2C:
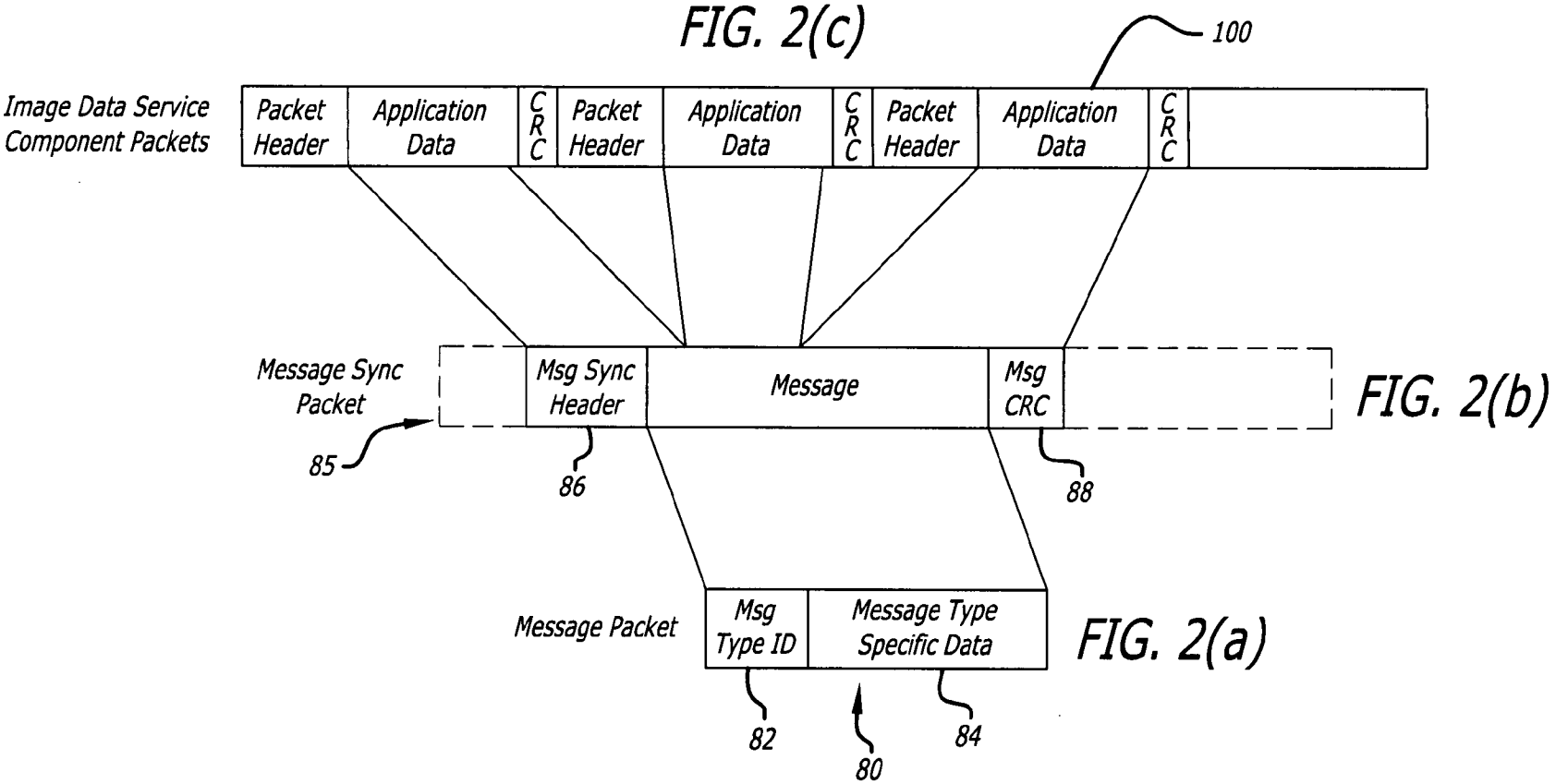
FIG. 2*a* is a diagram showing typical message packet output by the multiplexer in accordance with an illustrative embodiment of the present invention.
FIG. 2*b* shows a message sync packet in accordance with an illustrative embodiment of the present invention.
FIG. 2*c* shows a composite audio data service component packet adapted for wireless transmission with image data in accordance with the present teachings.

The images output by the picture show server are inserted into the digital data stream as illustrated in FIGS. 2*a-c* and output by a wireless radio data server 69.

FIG. 2*a* is a diagram showing a typical rolling image message packet 80 output by the multiplexer 58 in accordance with an illustrative embodiment of the present invention. The packet 80 includes a message identifier (ID) 82 and a message payload 84. As discussed more fully below, the message packets 80 include both Rolling Image content-type messages (messages containing images) and Rolling Image control-type messages (messages that associate and synchronize a series of Rolling Image content-type Messages to existing Audio Services).

FIG. 2*b* shows a message sync packet 85 in accordance with an illustrative embodiment of the present invention. As illustrated in FIG. 2*b*, the message sync packet 85 includes the message packet 80, a message sync header 86 and a message footer 88. In the illustrative embodiment, the message packet 80 is appended to a message synchronization header 86 and prepended to a cyclic redundancy checksum footer (header) 88 by the picture show server 62 of FIG. 1.

FIG. 2*c* shows a stream of Image Message Sync Packets that are segmented into Data Service Component Packets (DSCP) in accordance with an illustrative embodiment of the invention. The DSCP consists of a DSCP Packet Header, a Payload (containing a complete or partial segment of a Image Message Sync Packet), and a DSCP CRC word for error checking. The DSCP Packet Header contains a DSCP Sync Word and a Packet Length field. The data service component packet stream 100 is output by the wireless radio server 69. In the best mode, the wireless radio server 69 is an XM satellite radio server. However, the invention is not limited thereto. The server may be adapted for digital AM, High Definition Radio, AM, FM, Satellite Radio (e.g. Sirius) or other wireless communication technology without departing from the scope of the present teachings.

FIG. 3(*a*) is a diagram showing an over the air payload channel 200 adapted for in use in connection with satellite digital audio radio service transmission of Rolling Images in accordance with the present teachings. Sync pulses 202 and 204 allow a receiver to synchronize with the bit stream. In a conventional Satellite Digital Audio Radio Service (SDARS) system, each Service Component, identified by a Service ID, normally carries the audio data stream only for one User Channel/Station as depicted in FIG. 3(*b*).

FIG. 3(*b*) is a diagram showing typical audio payload channel as conventionally disposed within an over the air payload channel adapted for the transmission of audio data in accordance with conventional teachings. In this case, the Service Component is of Type='Audio'. However, a Service Component Type can also be defined as 'Transparent Data'. In this case, general applications (non-audio, typically data oriented) can utilize the Transparent Data Service Component for the communication of the specific application data. These applications apply some form of a message-formatting layer on top of the Transparent Data to coordinate and synchronize the transfer of application information from an information source to the radio receivers. In a conventional SDARS system, these general applications, carried over Service Components of type Transparent Data, are non-related and asynchronous to the Audio Services (Audio Channels carried over Service Components of Type Audio). However, this invention implements a visual-type application, which utilizes the Transparent Data Service Component for communication and for which the visual application is also related/associated to and synchronized to the existing Audio Services by the methods described herein.

FIG. 3(*c*) is a diagram showing a Payload Channel 210 that contains a Service Component adapted for the transmission of image data in accordance with an illustrative embodiment of the present teachings. As depicted in FIG. 3(*c*), at least one Service Component, identified by a Service ID is adapted to carry Rolling Image data. This is illustrated in FIG. 3(*c*) by the transparent data component stream 100 containing the Rolling Image data message packets. In accordance with the present teachings, this stream is modified as shown in FIG. 3(*c*) to accommodate images. That is, as shown in FIG. 3(*c*), the image data service component 100 is disposed within a Payload Channel. In the best mode, the Image Data Service Component contains all the Rolling Image Messages for all the Picture Shows. Each Picture Show is associated with an Audio Service via control-type Rolling Image Messages (e.g. the Picture Show Service Reference Message that links Picture Show Unique IDs to Audio Services Service IDs).

FIG. 3(*d*) is a diagram showing an expansion of the Service Component Control Field (SCCF) of the Payload Channel depicted in FIGS. 3(*a-c*). The SCCF also includes the Service ID field that uniquely identifies the Service. The Service Component Type message is a digital word that is interpreted by the source decoder 416 of FIG. 5 below and used to route the image message packets accordingly. Those skilled in the art will appreciate that the source decoder may use the Service Component Type message in a lookup table, a logic statement or other suitable means common in the art.

FIG. 3(*e*) is a diagram showing the TSCC (Time Slot Control Channel) in accordance with an illustrative embodiment of the present teachings. The TSCC 211 is juxtaposed between sync pulses 202 and 204. The TSCC 211 provides information to a receiver as to how the slots are allocated in the channel 200. The remaining slots are allocated for audio and control currently. The TSCC 211 includes all information necessary to de-multiplex the bit stream to Payload Channels 220 and 210 (FIG. 3(*b*) and FIG. 3(*c*)), and 230 (FIG. 3(*e*)).

As shown in FIGS. 3(*b*), 3(*c*) and (*e*), each Payload Channel contains a SCH (Service Control Header) 222, 212 and 232 respectively. The SCH provides information used to de-multiplex the respective Payload Channel into individual Service Components.

FIG. 3*f* is a diagram showing an association of picture shows to audio services and insertion into a transport layer in accordance with an illustrative embodiment of the present teachings. As shown in FIG. 3*f*, the stream 90 includes, inter alia, plural audio service components 92 (Service Data A in FIG. 3(*b*)) and a Transparent Data Service component 94. The Transparent Data Service component 94 contains Rolling Images image data messages 96 and a Picture Show Service Reference message 98. The Service Component is identified as Transparent Data type by the Service Component Type field. The Service Component Type field 213 is part of the Service Component Control Field (SCCF) as shown in FIG. 3(*d*).

As illustrated in FIG. 3*f*, the Picture Show Service reference message 98 correlates audio service components 97 with image data messages 96. The reference message 98 is used by the source decoder 416 to associate the picture shows with the audio components. That is, on request from the microcontroller, the data component extractor 420 extracts and outputs a raw bit stream to the micro-controller 422 of FIG. 5 as discussed more fully below.

As discussed more fully below, in an alternative embodiment, the invention associates images to Artists/Song Labels by means of the Picture Show Label Reference Message 102 as shown in FIG. 3*g*.

FIG. 3*g* is a diagram showing an association of picture shows to audio services by labels and insertion into a transport layer in accordance with an alternative embodiment of the present teachings. In the baseline (audio-only) system, Artist and Song Labels are communicated and associated with the currently playing audio streams by means of the Artist/Song Label Messages. The Artist/Song Label Messages are transmitted in the Broadcast Information Channel (BIC) 101 that is shown in FIG. 3(*e*). This message includes the Artist Name Label, Song Name Label and the Service ID that is currently transmitting the Audio program (e.g. Song) that the labels are associated with. In the illustrative embodiment, image data is associated to Artist/Song Labels which, in-turn, by means of the Artist/Song Label Message, associates the images to currently transmitted Audio programs. A flow chart showing an illustrative scheme by which the microcontroller implements this process is shown in FIG. 7(*b*).

FIGS. 3*f* and 3*g* also show the Image Data Messages, the Picture Show Label Reference Message 102, and the Picture Show Service Reference Message 98 all being time multiplexed into the same Transparent Data Service Component. In this manner, all the image data associated with multiple Audio Service Components may be time multiplexed within this single Data Service Component in order to statistically multiplex the instantaneous image data throughput demands of each Picture Show. This enables optimal image frame rates for a fixed allocation of bandwidth.

Figure 4:
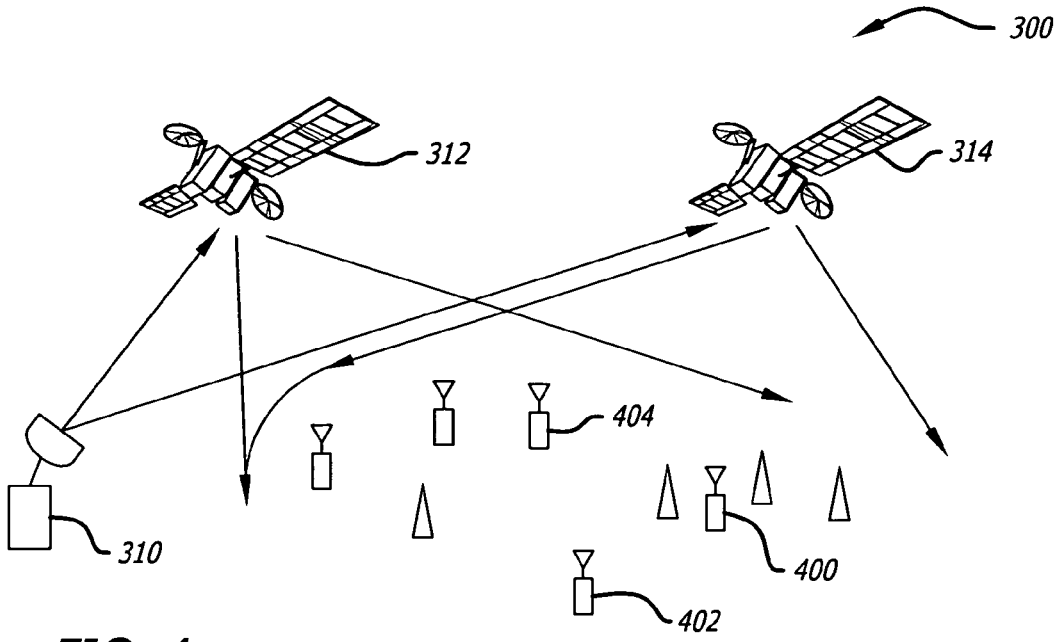
FIG. 4 is a diagram of an illustrative satellite radio network in accordance with conventional teachings.

In the illustrative implementation, the payload channel is transmitted over the air via a satellite network 300 such as that depicted in FIG. 4.

FIG. 4 is a diagram of an illustrative satellite radio network in accordance with conventional teachings. The network is disclosed and claimed more fully in U.S. Pat. No. 6,510,317, issued Jan. 21, 2003 to P. Marko et al. and entitled SATELLITE DIGITAL AUDIO RADIO SERVICE TUNER ARCHITECTURE FOR RECEPTION OF SATELLITE AND TERRESTRIAL SIGNALS, U.S. Pat. No. 6,823,169, issued Nov. 23, 2004 to P. Marko et al. and entitled LOW COST INTEROPERABLE SATELLITE DIGITAL AUDIO RADIO SERVICE (SDARS) RECEIVER ARCHITECTURE, the teachings of which are incorporated herein by reference. The network 300 includes plural satellites 312 and 314 that redirect a payload channel transmitted from an uplink station 310 to plural mobile receivers 400, 402, 404, etc.

Figure 5:
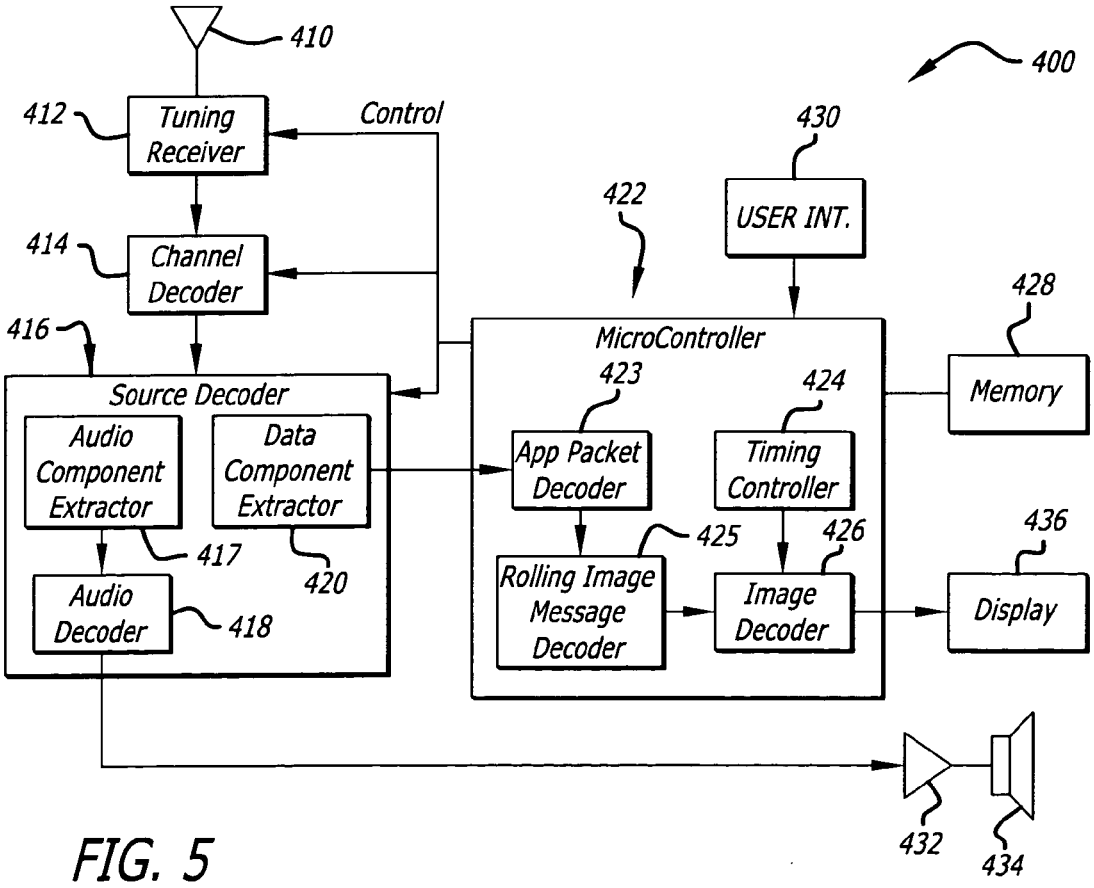
FIG. 5 is a simplified block diagram of an illustrative implementation of a receiver adapted for use in accordance with the present teachings.
Figure 6:
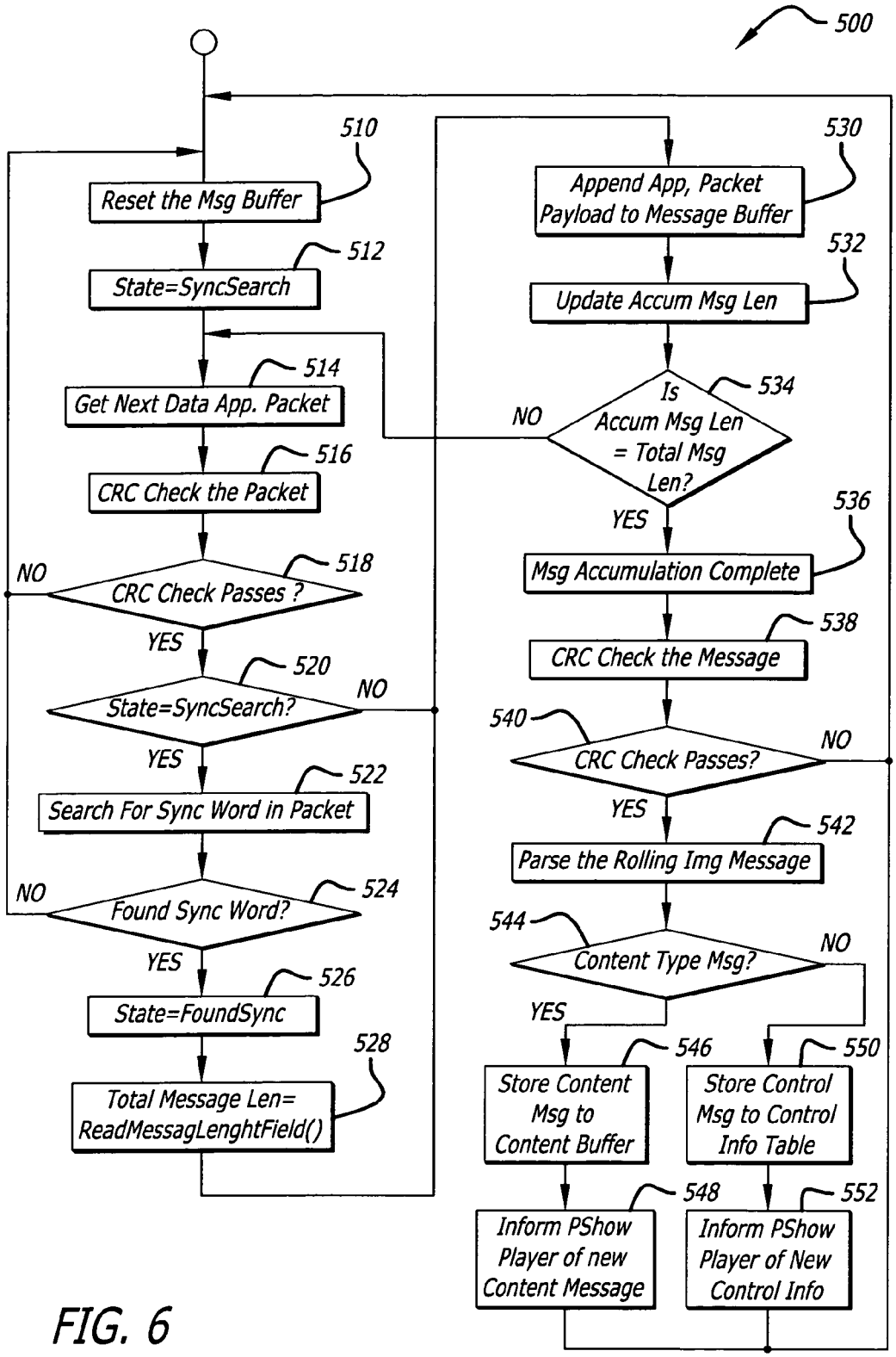
FIG. 6 is a flow diagram of an illustrative implementation of software stored on physical media (not shown) and executed by the controller of FIG. 5 for effecting Rolling Image message acquisition in accordance with the teachings of the present invention.

FIG. 5 is a simplified block diagram of an illustrative implementation of a receiver adapted for use in accordance with the present teachings. As shown in FIG. 5, the receiver 400 includes an antenna 410 that receives the over the air signal by which the payload channel is transmitted. The received signal is downconverted and the payload channel is detected. A channel decoder 414 decodes the payload channel and converts the signal into a bitstream. A bitstream with composite data and audio information is provided to a source decoder 416 by the channel decoder 414. The source decoder 416 separates the data and audio components in the bitstream. The audio components are sent to a speaker 434 via an amplifier 432. The data component is extracted and forwarded to a controller 422. The controller 422 parses the data and determines whether any image data is associated with the current audio output. That is, the controller 422 searches the stream for the message sync pulse and the message type from the messaging layer of the protocol. As mentioned above, the message type could be 'audio' or 'transparent data'. If 'transparent data', it could be 'control-type' or 'content-type' data. If 'control-type' it could be the Picture Show Service Reference message discussed above. If 'content-type', it could be an image message. The controller 422 processes the message as illustrated in FIGS. 6 and 7 below. If a 'content-type' message is received, the controller 422 passes the image to an image decoder 426. The image decoder 426 may be implemented in hardware or software.

The image decoder 426 converts the data into a format suitable for display and outputs the signal to a display 436. The decoder also interfaces with a memory 428. The memory 428 is provided to allow the user to store audio and image data in response to input from a user via an interface 430. The decoder 426 stores and retrieves images from memory as appropriate based on the signals decoded from the channel. The memory also provides a means of storing images that are part of a Picture Show that are transmitted at a slower rate than the rate intended for playback. The receiver 400 caches all these images to the memory 428 over a relatively long period of time. After all of the images of a Picture Show are acquired, the Picture Show may then be displayed on user request or based on signals decoded from the channel. When the playback rate approaches 66 milliseconds (15 frames per second) and greater, the Picture Show may be categorized as a 'video' application. As such, those skilled in the art will appreciate that the inventive system is enabled to advantageously transmit and display video information over conventionally audio only channels as well as a slide show per se.

FIG. 6 is a flow diagram of an illustrative implementation of software 500 stored on physical media (not shown) and executed by the controller 422 of FIG. 5 for effecting Rolling Image message acquisition and decoding in accordance with the teachings of the present invention. The flow diagram of FIG. 6 illustrates the operation of the Application Packet Decoder 423 and Rolling Image Message decoder 425 of FIG. 5.

As shown in FIG. 6, the software includes code for initializing the system and resetting a message buffer at step 510. At step 512 the system sets the state to search for a message sync pulse. At step 514, the system searches for a next application data packet in the transparent data. As shown in FIG. 2(*c*), each packet is an SID packet and has a packet header, application data (with the Rolling Image messages) and a cyclic redundancy check bit or bits.

Next, at steps 516 and 518, the software 500 performs a CRC check. If the packets pass the CRC check (i.e. no bit errors), then at step 520, the state is checked. If the system is still in 'synch search' state, then at step 522 the system searches the application packet for a sync word. If the sync word is not found (step 524) or if the CRC check fails at step 518, then the system returns to step 510 and continues with the message buffer reset. If the synch word if found at step 526, then the state is set to 'FoundSync' and at step 528, the message length field following the sync word is read. At step 530, the application packet payload is appended to the message buffer. Next, at step 532, the accumulated message length is updated at step 532. Clearly, these steps serve to accumulate application packets to generate a complete message. At step 534, the system checks to determine if the accumulated message length is equal to the total message length. If not, then it retrieves the next packet at step 514. If so, the message accumulation process is complete (step 536) and a CRC check is performed on the message (step 538).

At step 540, if the CRC check on the message fails, the message buffer is reset and the code returns to step 510 to retrieve the next data application packet. If, however, at step 540 the CRC check on the message passes, then at step 542, the Rolling Image message is parsed.

Next, at step 544, the system checks to determine if the Rolling Image message is a content type message. If so, then at step 546, the message is image data and is stored in a Content Buffer. Then, at step 548, the Picture Show Player is informed of receipt of a new Content message.

If at step 544 the system determines that the message is a control type message, then at step 550 the message is stored in a Control Information table. At step 552, the Picture Show Player is informed of receipt of new control information.

Figure 7A:
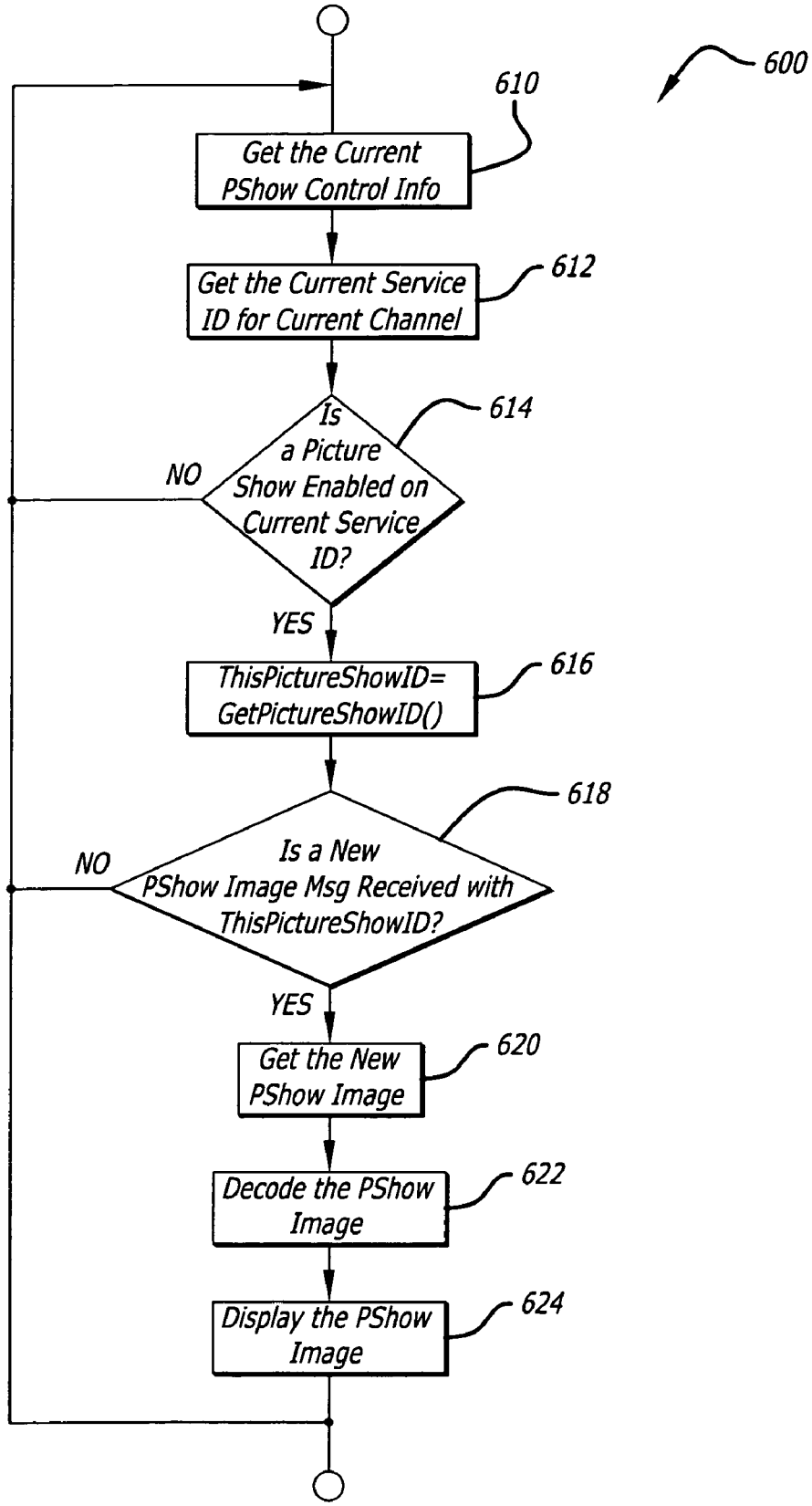
FIG. 7*a* is a flow diagram of an illustrative implementation of software stored on physical media (not shown) and executed by the controller of FIG. 5 for displaying Picture Show images in accordance with the teachings of the present invention.

FIG. 7*a* is a flow diagram of an illustrative implementation of software stored on physical media (not shown) and executed by the controller 422 of FIG. 5 for displaying Picture Show images in accordance with the teachings of the present invention. After the message has been acquired, the software executes the process 600 shown in FIG. 7*a*. The flow diagram of FIG. 7*a* illustrates the operation of the Timing Controller 424 and Image Decoder 426 of FIG. 5.

Here, at step 610, the current picture show control information (i.e., from the reference message 98) is procured. Next, at step 612, the current service ID for the current user selected audio channel is obtained. Then, at step 614, the system checks to determine if Picture Show mode is enabled on the current service ID. If so, at step 616, the system 422 acquires a picture show ID from the reference message 98. If not, then the system returns to a wait state before step 610.

Next, at step 618, the system checks to determine whether a new Picture Show Image message is received with the Picture Show ID acquired in step 616. Here, the system is checking the image message buffer for an image with the Picture Show ID identified in step 616. If so, then the image is acquired in step 620, decoded in step 622 and displayed in step 624. If not, then the system returns to a wait state before step 610.

Figure 7B:
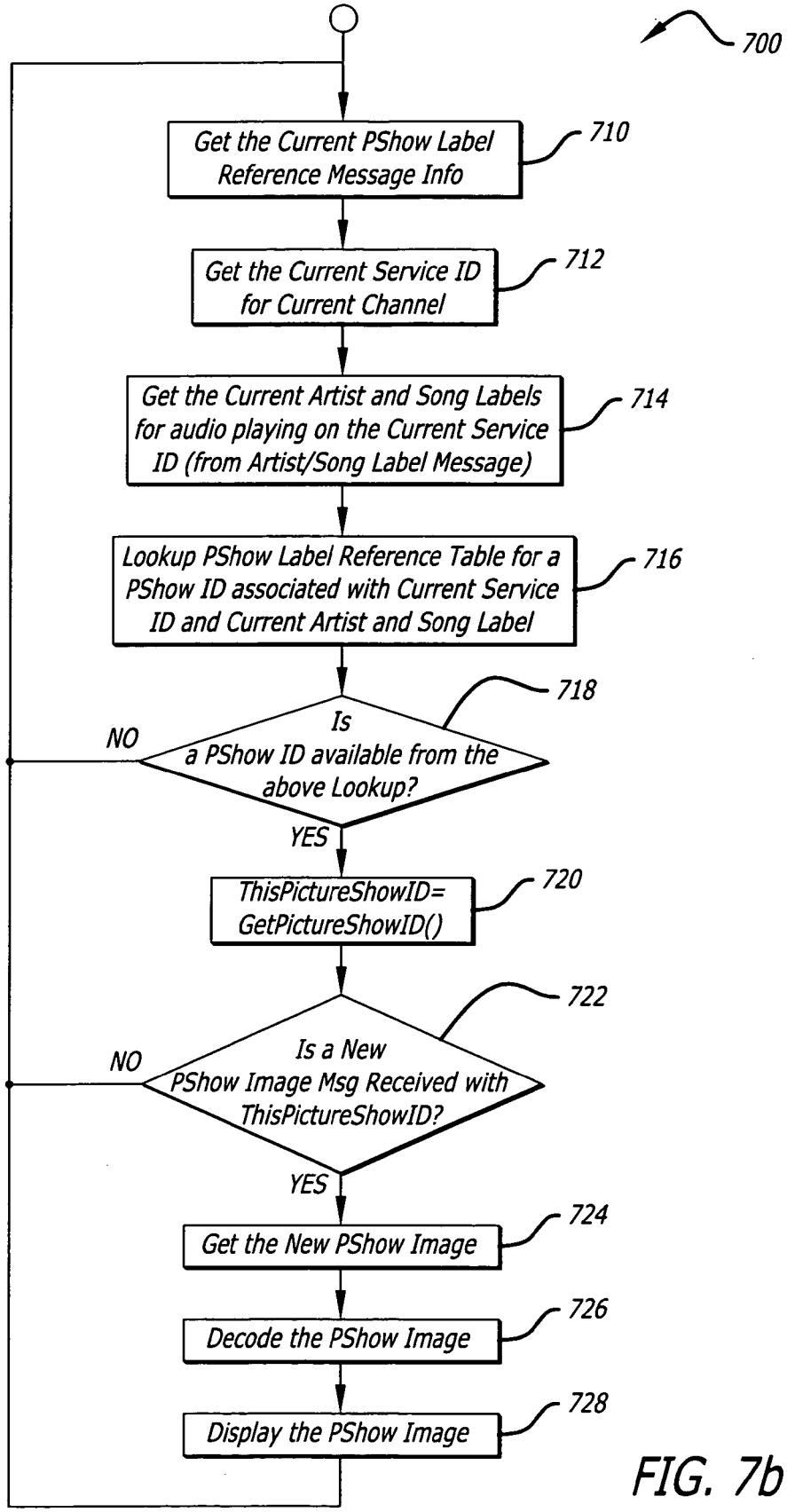
FIG. 7*b* is a flow diagram of an illustrative implementation of software stored on physical media (not shown) and executed by the controller of FIG. 5 for associating images to Artist/Song Labels which, in-turn, by means of the Artist/Song Label Message, associates the images to currently transmitted Audio programs in accordance with an alternative embodiment of the teachings of the present invention.

FIG. 7*b* is a flow diagram of an illustrative implementation of software stored on physical media (not shown) and executed by the controller of FIG. 5 for associating images to Artist/Song Labels which, in-turn, by means of the Artist/Song Label Message, associates the images to currently transmitted Audio programs in accordance with an alternative embodiment of the teachings of the present invention. In this embodiment 700, at step 710 the current picture show label reference message is acquired. Then, at step 712, the current Service ID for the current channel is obtained. Next, at step 714, the current artist and song labels for the audio playing on the current Service ID is obtained. At step 716, the system looks in the Picture Show label reference table for a Picture Show ID associated with the current Service ID and current artist and song label. Next, at step 718, the system checks to see if a Picture Show ID is available from the lookup in step 716. If so, then at step 720, the Picture Show ID is set equal to the current picture show ID. If not, the system returns to the start of the routine. Next, at step 722, the system checks to determine if a new Picture Show image message is received with the current picture show ID. If so, then at step 724, the new Picture Show Image is obtained. If not, the system returns to the start of the routine. At step 726, the picture show image is decoded and at step 728, the image is displayed.

Figure 8:
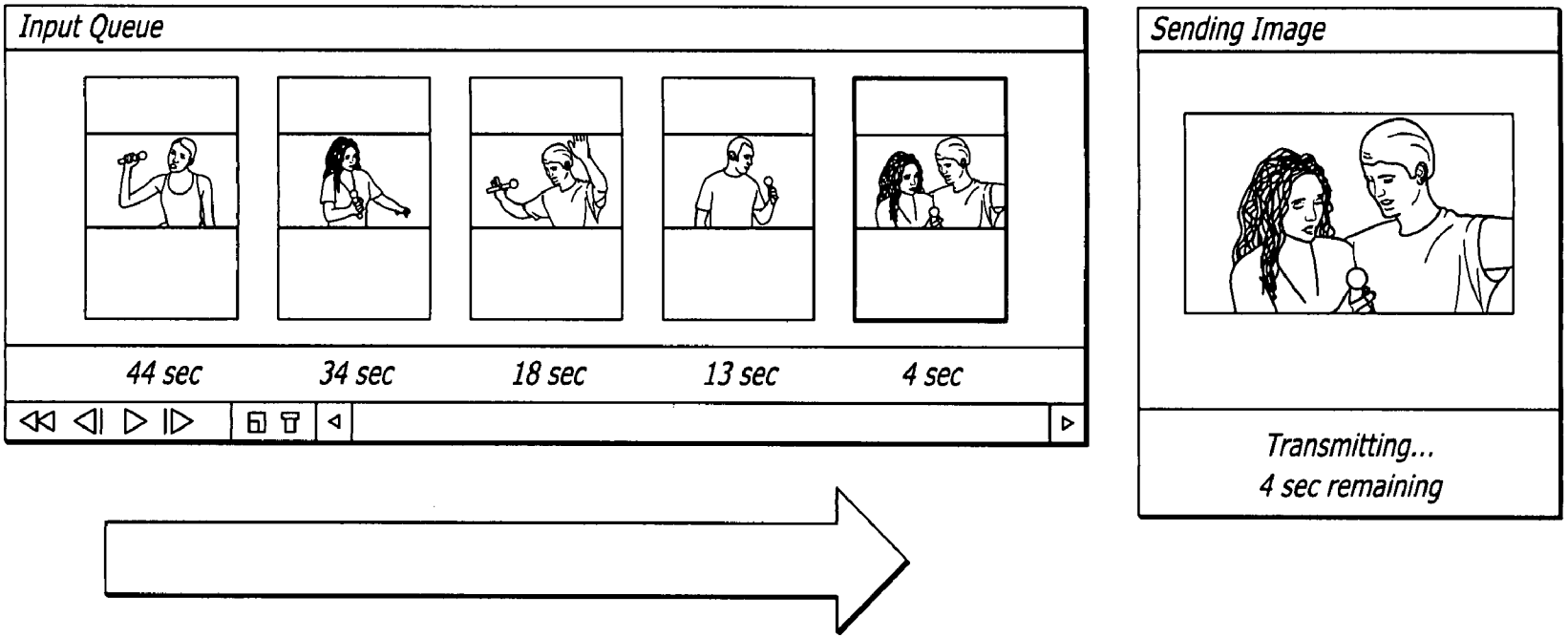
FIG. 8 is illustrates an image data stream output by the display of FIG. 5 in accordance with an illustrative embodiment of the present teachings.

FIG. 8 illustrates an image data stream output by the display 436 of FIG. 5 in accordance with an illustrative embodiment of the present teachings. In the illustrative embodiment, the images are still images presented in sync with the audio being output by the speaker 434. The timing and the duration of the images is determined using the image service shown and described above with respect to FIG. 1. These 'rolling' images may be presented in a variety of manners such as the following types:

1. Rolling Images associated with long duration Audio Programs (Long Duration Rolling Images):
   - An example of long duration audio program is a program of 30 minute duration or longer (news, sports show, interview, concert, or talk show).
   - A Sequence of Transmitted Images which makeup the "Picture Show" are associated with and displayed with currently playing Audio Programs.
   - Specific Picture Show Image-to-Audio Program associations are specified by either Category ID or Service ID. A single instance of a Picture Show can be associated and presented on multiple Categories and/or multiple Service ID's (presented with multiple audio components on multiple Categories and/or multiple Service IDs/Channels).
   - The timing of the overall Picture Show is specified by Picture Show Date (m/d/year), Start Time, and Duration.
   - The presentation timing of each individual image composing the Picture Show is specified by either the time when the image is received at the Radio or by a Delta Timestamp relative to the Picture Show Start Time.
2. Rolling Images associated with Short Duration Audio Programs (Short Duration Rolling Images):
   - An example of a short duration audio program is a program of 3 minute duration or less (a Song or a Commercial).

One or more images of an image set can be Synchronized to the audio program by means of matching to existing Labels (Song/Program Labels and or Artist Labels) which themselves are already tightly synchronized with the audio program.

The presentation timing of each individual image composing the Picture Show is specified by either the time when the image is received at the Radio or by a Delta Timestamp relative to the Picture Show Start Time.

For exact presentation of the image(s) at the start of the Audio Program, the first image must be received by the Radio at or before the start of the Program. For the Real-Time image delivery mode (see below description), the Image Server anticipates the start of the Audio Program and starts the transmission of the first image ahead of the actual Program start time. The Image Server compensates for the latency in transmitting the full image message and the latency due to waiting for completion of other images that are also being transmitted on a shared, limited bit rate channel.

To achieve the high degree of image and audio synchronization required for this purpose the Picture Show Reference Message 98 (FIG. 3*f*) may be used. As an alternative, artist, song or label information may be transmitted via the transparent data as disclosed above with respect to FIG. 3*g*. In the latter case, an artist's, song or label is associated with a Picture Show unique ID. Hence, when the artist, song or label is received in the Service ID, the Player automatically displays the image stored with the associated the Picture Show ID.

Modes of Image Delivery

Images may be delivered by a number of modes such as: Real-Time Streaming, One-time Download/Playback, and continuous Carousel.

Real-Time Streaming Mode

Images are delivered just in time at the correct presentation time.

One-Time Download/Playback Mode

The full set of images is delivered before the start of the associated audio show. The Radio stores the images and later Plays the images at their times specified once the associated Audio Program has started. The advantage of this Mode is that images sets may be delivered during off-peak times when extra bandwidth is available. This mode cannot be used for live programs. The Radio continuously receives and stores all images delivered in this Download/Playback mode in anticipation of playing back the images at a later time.

Continuous Carousel Mode

A large set of images is repeatedly transmitted as part of a "Carousel" of images. Radios continuously monitor and receive the images until all images are received.

Transmitting images in this manner is suitable when the images are relatively static (are not updated over periods of weeks or months) and it is acceptable to have a relatively long initial latency before all images are received by the radio. This mode can be suitable to static and limited total numbered images such as Commercials and other repeating Programs requiring just one or a few associated images.

Illustrative Message Synchronization Packet Description

| Field Name | Field Length (bits) | Value/Description |
|---|---|---|
| | | Message Sync Layer |
| Message Packet Start Sync Word | 48 | Value = ASCII $XMMX$ |
| Message Packet Length | 16 | Total length of this Message. Packet in bytes. Value = 1 to 65,535 bytes |
| | | Message Application Layer |
| Message Type ID | 8 | |
| Message Content | Var | |
| Message CRC | 16 | 16-bit CRC for overall message. Same polynomial as DSC CRC. Intended to reduce probability of message falsing (i.e. data content coincidently matches the Message Start Sync pattern and all other data length fields also match). |

Details of an Illustrative Rolling Images Messaging Layer

In the illustrative embodiment the system utilizes the following messages and message structure to implement Rolling Image Services.

Messages for Long Duration Rolling Images Implementation

Picture Show Image Message

Contains one image of the set of images composing a Picture Show.

Picture Show Instance Info Message

Contains information required for presenting the Picture Show, that is relatively dynamic and changes for every instance of the Picture Show (i.e. a Picture Show can be associated with a daily or weekly reoccurring Audio Program. Some of the Picture Show info changes for each instance, but some info is the same from Show to Show (text title etc.). This message must be transmitted at a relatively high rate.

Picture Show Static Info Message

Contains static and slowly changing info about a Picture Show. E.g. Text Title and Text Description for a periodically reoccurring Program.

Picture Show Service Reference Message

Associates each Picture Show with a Service ID or multiple Service IDs that the Show is played on.

Picture Show Category Reference Message

Associates each Picture Show with a Category ID or multiple Category IDs that the Show is played on i.e. a Picture Show is played when the user tunes to any channel of the specified Category.

Illustrative Picture Show Image Message Structure:

| Field Name | Description |
|---|---|
| Message Type Identifier | Picture Show Image Class1 Message |
| Picture Show Unique ID | Unique ID for the Picture Show to which this Image Message belongs. |
| Image Index Number | Index number. Increments for each new image of for the Picture Show. Also serves as a Sequence Number. For long Image update intervals, the same image may be retransmitted at some shorter interval. In this case, this Index Number remains the same. The Radio can choose to skip processing these duplicate messages. The timestamp will also remain the same as the original/initial image for these repeated images. Concatenation of the "Picture Show Unique ID" with this "Image Index Number" gives a "Unique Image ID". |
| Max Display Time Duration | Maximum Time Duration for which to display the image. e.g. if no new images are received to replace this image.<br>Units in seconds (1 to 65,535 sec)<br>0 = Unlimited duration. |
| Delta Timestamp | Optimal display time for this image. Represented as an offset time from the "Picture Show Start Time" (from the Picture Show Reference Message). Units of 1,296 msec (XM 432 msec frame × 3).<br>Value = 0x3FFFF specifies no timestamp and the Radio can display this image as soon as it is received. |
| Image Transition Effect | Transition this Image from the previous image using this Effect.<br>0 = None<br>1 = Slide<br>2 = Wipe<br>3 = Through Black<br>4 = Through White<br>5 = Inset<br>6 = Iris<br>7 = Pixellate<br>8 = Blinds<br>Values = 9 to 31 TBD |
| Image Content Subcategory Type | 0 = GIF<br>1 = JPEG |
| Title Text Length | Length of Title text string in characters<br>0 = No header text.<br>Max = 40 characters |
| Body Text Length | Length of Text String in characters<br>0 = No text.<br>Max = 1023 characters. |
| Title Text String | Title Text String<br>Plain text format. No Null termination. |
| Body Text String | Body Text String<br>HTML text format. |
| Text Color | 24-bit RGB |
| Text Background Color | 24-bit RGB |
| Text Border Color | 24-bit RGB |
| Image Border Color | 24-bit RGB |
| Outer Image Frame Border Color | 24-bit RGB |
| Image Background Color | 24-bit RGB<br>The Image Background Color is relevant for Transparent GIF |
| Outer Image Frame Background Color | 24-bit RGB |
| Image Width | Width in pixels<br>Max = 260 |
| Image Height | Height in pixels<br>Max = 196 |
| Length of Variable Field | Length of Variable Data Field in Bytes (Min 0, Max 255)<br>This section allows future parameters to be added to this message. Legacy Radios will skip this section, while newer Radios may process this section. |
| Variable Data | Min 0, Max 255 bytes |
| Image Data Length | Length in bytes for the image content data.<br>0 = No Image (text only).<br>Max = 40,000 bytes ~4:1 compression for max. 260 × 196 image. |
| Image Data Content | Length is variable. Min Len = 0 byte. Max Len is 40,000 bytes. |

Of note in the above Picture Show Image Message structure is the Image Transition Effect field. This field specifies to the receiver 400 the image transition effect to apply between the currently displayed Picture Show Image and the newly received Picture Show Image that will be displayed next.

The present teaching has disclosed the delivery of visual/image data and methods of associating and synchronizing this image data to Audio Channels in connection with an existing conventional radio system. In the primary use case, this visual/image data is relatively slowly updated to minimize bandwidth usage in audio centric systems, e.g. 5 second image update period for a Picture Show. However, as mentioned above, using the same methods described here and with additional bit rate allocated to the utilized Transparent Data Service Component, faster image updates may be implemented. When these image update periods approach 66 msec (15 frames/sec), a video application is achieved using the same methods described. That is, those skilled in the art will appreciate that the inventive system is enabled to advantageously transmit and display video information over conventionally audio only channels as well as a slide show per se.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. In an audio system without imaging support for wirelessly transmitting and receiving a primarily audio data stream via over-the-air audio radio service, an improvement wherein said improvement comprises:

first means for providing an image; and second means for inserting said image into said audio data stream prior to transmission thereof via the over-the-air audio radio service in the audio system without imaging support, said audio data stream comprising audio channels and said image corresponding to at least one of said audio channels;

wherein said audio data stream comprises service components corresponding to audio services provided via said audio channels, at least one service component comprising said image and reference information associating said image data with at least one audio service of said audio channels, and control data identifying the respective service components as one of audio and image.

2. The invention of claim 1 wherein said image is a video image.

3. The invention of claim 1 further including third means for receiving and decoding said audio data stream after it has been transmitted via the over-the-air audio radio service to extract said image.

4. The invention of claim 3 further including fourth means for displaying said image.

5. The invention of claim 4 wherein said fourth means is a digital radio.

6. The invention of claim 5 wherein said fourth means is at least one of a satellite radio, a high definition radio and a digital AM radio.

7. The invention of claim 1 wherein said first means includes means for automatically inserting a selected image in said audio data stream prior to transmission thereof via the over-the-air audio radio service in the audio system without imaging support.

8. The invention of claim 7 wherein said means for automatically inserting includes a source selector.

9. The invention of claim 8 wherein said means for automatically inserting includes an image editor coupled to said source selector.

10. The invention of claim 9 wherein said means for automatically inserting includes an image resizer.

11. The invention of claim 10 wherein said means for automatically inserting includes an image compressor.

12. The invention of claim 11 wherein said means for automatically inserting includes means for allowing a user to add text, color, style and/or other information to an image output by said compressor.

13. The invention of claim 12 wherein said means for automatically inserting includes means for adding images from an archive to said stream.

14. The invention of claim 7 wherein said means for automatically inserting includes a real time graphical picture show composer for providing an image queue.

15. The invention of claim 1 further including an image server.

16. The invention of claim 15 further including a satellite radio server coupled to said image server.

17. In an audio system without imaging support for wirelessly transmitting and receiving an audio data stream via over-the-air audio radio service, an improvement wherein said improvement comprises the steps of:

providing an image; and inserting said image into said audio data stream prior to transmission thereof via the over-the-air audio radio service over-the-air audio radio service in the audio system without imaging support, said audio data stream comprising audio channels and said image corresponding to one of said audio channels;

wherein said audio data stream comprises service components corresponding to audio services provided via said audio channels, at least one service component comprising said image and reference information associating said image data with at least one audio service of said audio channels, and control data identifying the respective service components as one of audio and image.

18. The invention of claim 17 wherein said image is a video image.

* * * * *